US006196742B1

(12) United States Patent
Tarver, III

(10) Patent No.: US 6,196,742 B1
(45) Date of Patent: Mar. 6, 2001

(54) MUD APPLICATOR AND PNEUMATIC ACCESSORY TOOL FOR USE THEREWITH

(76) Inventor: John Tarver, III, 168 Hanna Ave., Dayton, OH (US) 45427

( * ) Notice: Subject to any disclaimer, the term of this patent is extended or adjusted under 35 U.S.C. 154(b) by 0 days.

(21) Appl. No.: 09/404,490

(22) Filed: Sep. 23, 1999

(51) Int. Cl.[7] ..... B28B 3/00

(52) U.S. Cl. ..... 401/5; 401/137; 401/171; 222/389; 425/87

(58) Field of Search ..... 425/87; 401/5, 401/137, 143, 146, 171; 222/389

(56) References Cited

U.S. PATENT DOCUMENTS

| | | | | |
|---|---|---|---|---|
| 2,288,987 | | 7/1942 | Allen | 216/33 |
| 2,666,323 | | 1/1954 | Ames | 72/130 |
| 2,858,953 | | 11/1958 | Harrell | 216/20 |
| 3,103,033 | * | 9/1963 | Ames | 401/171 |
| 3,112,225 | | 11/1963 | Harms . | |
| 3,451,757 | * | 6/1969 | Stroud et al. | 401/139 |
| 3,980,209 | * | 9/1976 | Collar | 222/323 |
| 4,127,434 | | 11/1978 | Lass | 156/526 |
| 4,516,868 | * | 5/1985 | Molnar | 401/5 |
| 5,181,636 | * | 1/1993 | Anderson et al. | 222/389 |
| 5,570,953 | | 11/1996 | Dewall | 366/10 |
| 5,603,428 | | 2/1997 | Breckwoldt | 220/755 |
| 5,605,251 | | 2/1997 | Retti | 222/1 |
| 5,676,793 | | 10/1997 | Martin | 156/578 |
| 5,711,462 | | 1/1998 | Hard | 222/385 |
| 5,759,343 | | 6/1998 | Roberts | 156/578 |
| 5,863,146 | * | 1/1999 | Denkins et al. | 401/188 R |
| 5,882,691 | * | 3/1999 | Conboy | 425/87 |

* cited by examiner

*Primary Examiner*—Henry J. Recla
*Assistant Examiner*—Peter deVore
(74) *Attorney, Agent, or Firm*—R. William Graham

(57) ABSTRACT

A mud applicator for applying mud to wall board includes a housing having a front open surface through which mud can pass, a plate movably connected within the housing such that the plate moves toward and away from the front open surface and a pneumatic drive mechanism operably connected to the plate to cause the plate to move toward the open surface in a manner such that when mud is disposed in the housing, the plate forces the mud out of the front open surface.

5 Claims, 5 Drawing Sheets

MUD APPLICATOR AND PNEUMATIC ACCESSORY TOOL FOR USE THEREWITH

BACKGROUND OF THE INVENTION

1. Field of the Invention

The present invention relates to a mud applicator. More particularly, the invention relates to improvements in mud applicators and the delivery mechanism associated therewith, namely a mud applicator and pneumatic accessory tool for use therewith wherein the pneumatic accessory tool is particularly useful with a flat runner squeeze box.

2. Related Art

There exist a number of mastic-applying and finishing tools. For example, there exists a mud applicator which includes a hollow housing for receiving wall board mud under pressure and being movable over a surface, wherein the housing has an opening to deliver the mud therethrough to the wall board surface. Some of the mud applicator's include a mud pump which pumps the mud to the housing and forces the mud out the opening. Other applicator's include a manually squeezable housing which permits the mud to be manually forced out of the opening by applying a manual force on a movable plate disposed within the housing.

While the pumping of mud to the housing has some appeal in the industry, there remains a great need for manually operated applicators. This is partly due to the fact that the large equipment needed to operate the mud pumping equipment and partly due to added handling weight to the operator.

Accordingly, there remains a need to improve manual mud applicators. The present invention fulfills the stated need.

BRIEF SUMMARY OF THE INVENTION

It is an object to improve mud applicators.

It is another object to improve existing manually operated mud applicators.

Still another object of the invention is to provide a retrofit accessory tool for use with existing manually operated mud applicators.

Yet another object is to provide a mud applicator and pneumatic accessory tool for use therewith.

Accordingly, the present invention is directed to a mud applicator for aiding in the application of mud to a surface of a wall board or the like. The device includes a housing having a front open surface through which mud can pass, a plate movably connected within the housing such that the plate moves toward and away from the front open surface. A pneumatic piston is operably connected to the plate to cause the plate to move toward the open surface in a manner such that when mud is disposed in the housing, the plate forces the mud out of the front open surface.

Other objects and advantages will be readily apparent to those skilled in the art upon viewing the drawings and reading the detailed description hereafter.

DETAILED DESCRIPTION OF THE INVENTION

Figure 1:
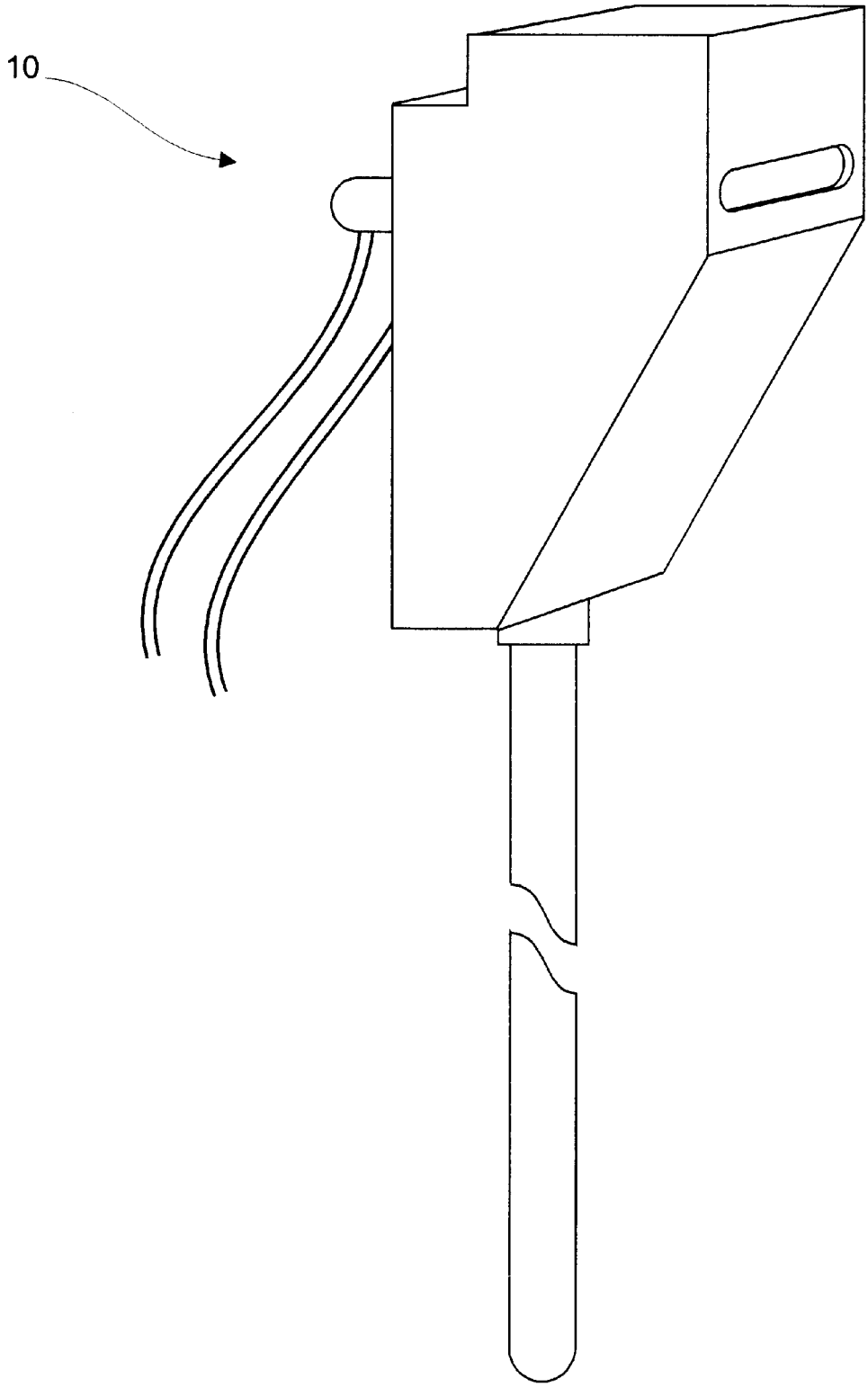
FIG. 1 is a perspective view of the present invention.
Figure 2:
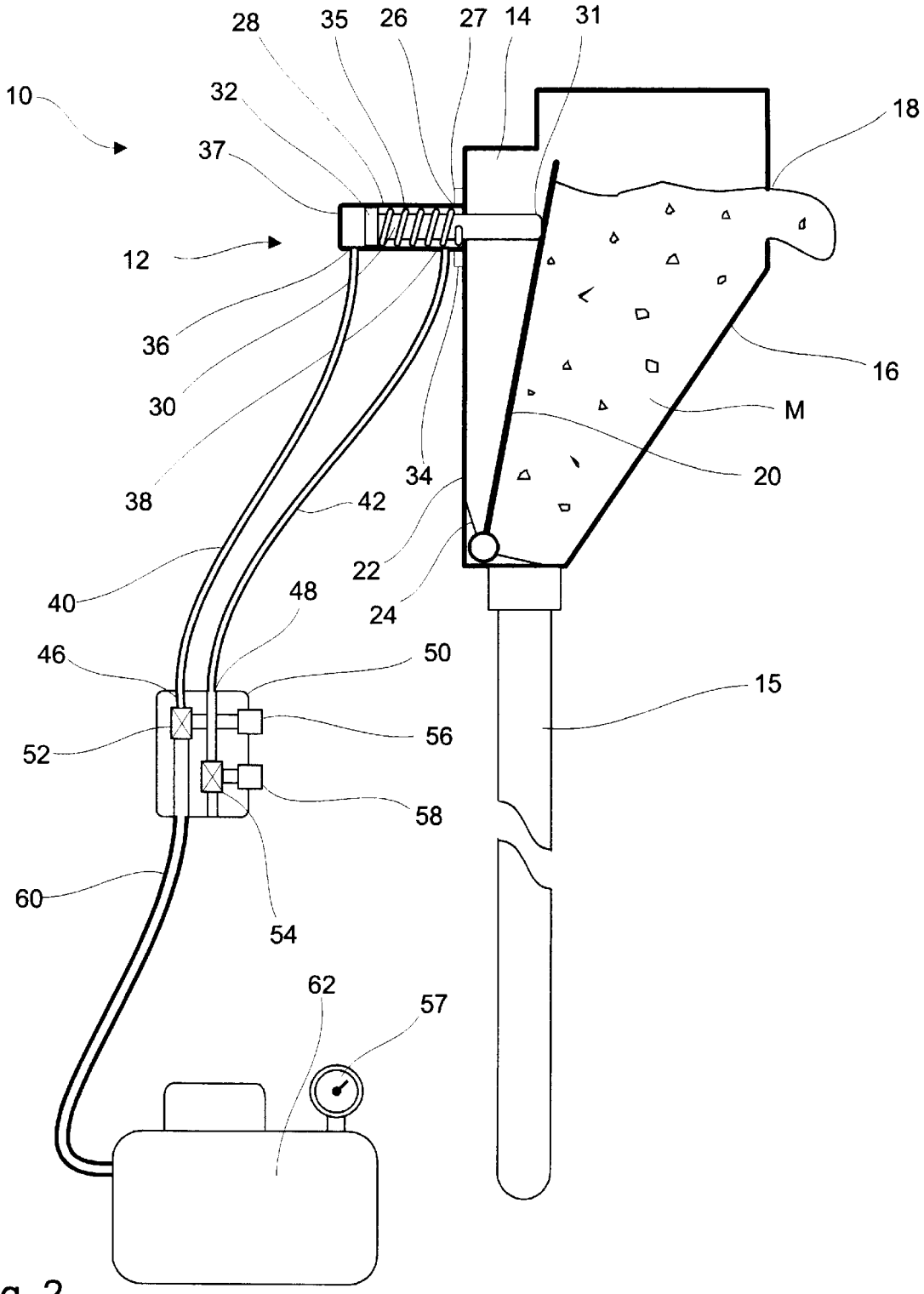
FIG. 2 is a cross-sectional view of an embodiment of the present invention.
Figure 3:
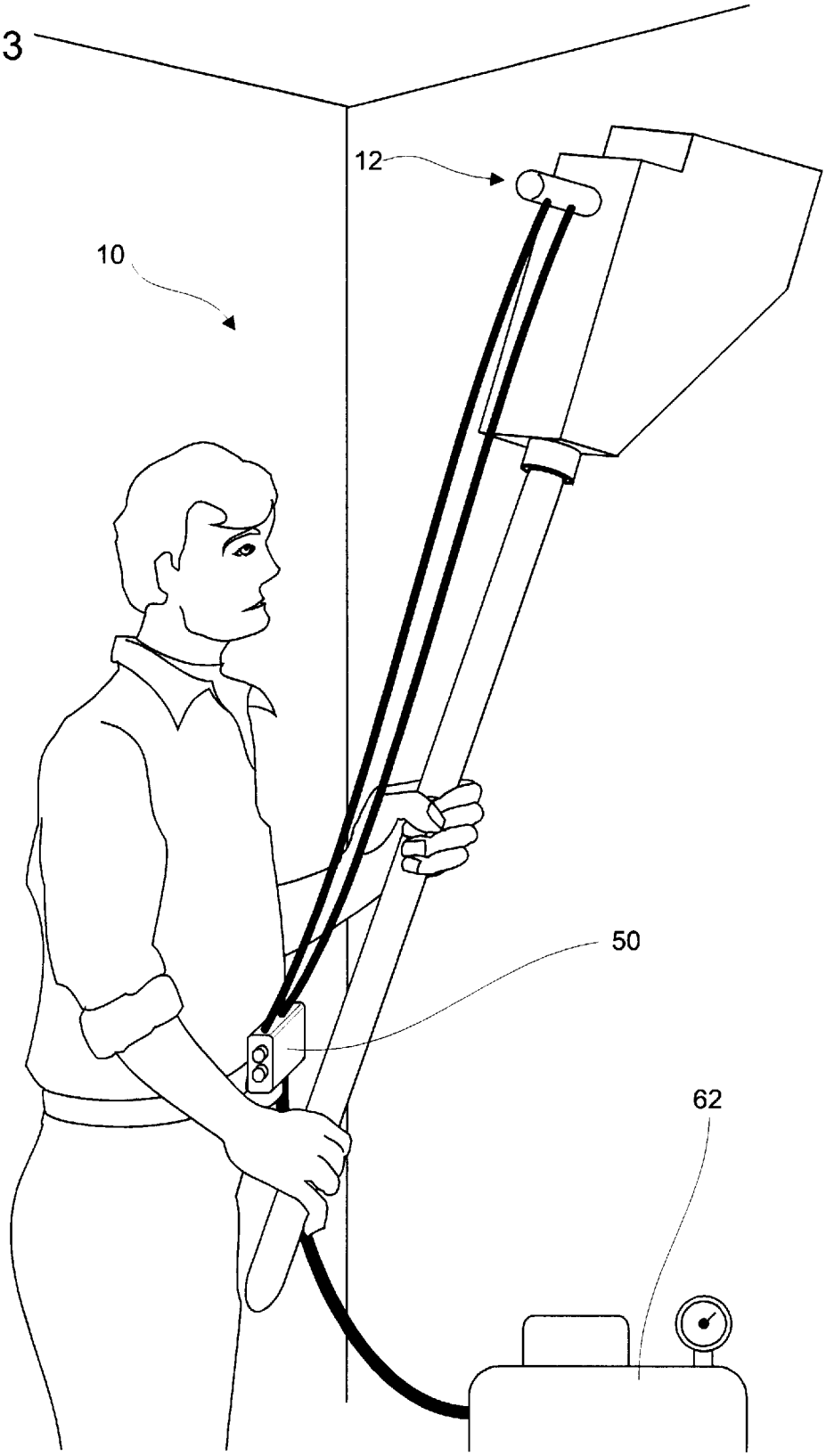
FIG. 3 is a view of the embodiment in FIG. 2 of the present invention in use.

Referring now to the drawings, the mud applicator shown in FIGS. 2 and 3 of the present invention is generally designated by the numeral 10. The mud applicator 10 includes a pneumatic accessory tool 12 for use with a flat runner squeeze box 14 having an elongated handle 15 connected thereto.

The flat runner squeeze box 14 includes a housing 16 having a front open surface 18 through which mud M moves. The flat runner squeeze box 14 includes a hingedly connected plate 20 therein. The plate 20 is preferably biased toward a back side 22 of the housing 16 by a spring 24.

The back side 22 includes an open surface 26. A piston cylinder 28 is connected to the back side 22 by way of a mounting bracket 27 adjacent the open surface 26. A piston 30 is reciprocally disposed within the cylinder 28 and includes a piston head 32. The piston 30 is limited in its travel by the piston head 32 and a cylinder sealing collar 34. A spring 35 is disposed about the piston 30 in a manner to bias between the piston head 32 and the cylinder sealing collar 34 thus normally causing the piston 30 to drive toward the end 37 of the cylinder 28. The piston 30 has an end 31 which contacts the plate 20.

The cylinder 28 includes an inlet 36 to receive pressurized air and an outlet 38 to exit pressurized air. Air pressure lines 40 and 42 communicably interconnect the inlet 36 and outlet 38, respectively, to air channel surfaces 46 and 48, respectively, of a regulator 50. The air channel surfaces 46 and 48 extend through the regulator 50 which is a block and can be of any suitable pressurized material, such as metal or plastic. Regulator valves 52 and 54 are operatively disposed in the channel surfaces 46 and 48, respectively. Regulator valve actuator knobs 56 and 58 are operatively connected to the valves 52 and 54, respectively.

The pressure lines 40 and 42 are preferably of a flexible lightweight material which is long enough such that the regulator 50 can be disposed on the user's belt or the like. In this regard the regulator 50 can be fashioned to be hand-held. The pressure line 60 should likewise be of material like lines 40 and 42 and be of sufficient length to permit adequate mobility at the work site.

The air channel surface 46 is communicably connected to another pressure line 60 which is communicably connected to a pressure tank 62 with a regulator gauge 57 having a compressor therein. The regulator valve actuator knob 56 preferably adjustably controls the valve 52 to control pressure to the cylinder 28 and thus the advancement of the piston 30 through the open surface 26 into contact with the plate 20. In this way, the mud M can be pushed out of the open surface 18 with the aid of the piston 20. When the piston head 32 abuts the sealing collar 34, the piston 30 has fully traveled toward the plate 20. At this point, the regulator valve actuator knob 58 can be actuated to cause the valve 54 to open thus permitting the pressurized air to exit through channel 48. The piston 30 and plate 20 are biased backward to permit mud M to be added to the box 14 to be refilled.

Figure 2A:
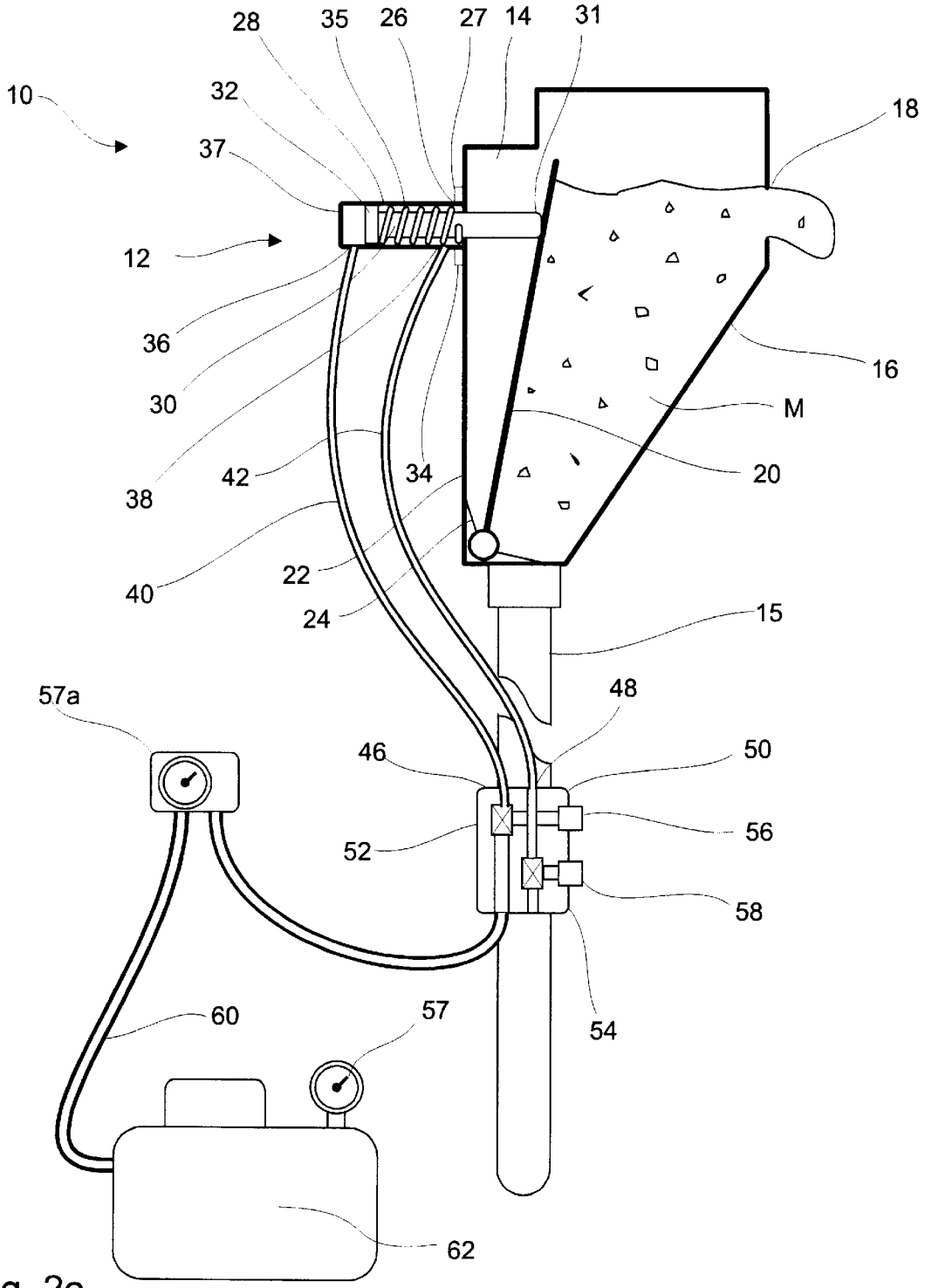
FIG. 2*a* is a cross-sectional view of another embodiment of the present invention.
Figure 3A:
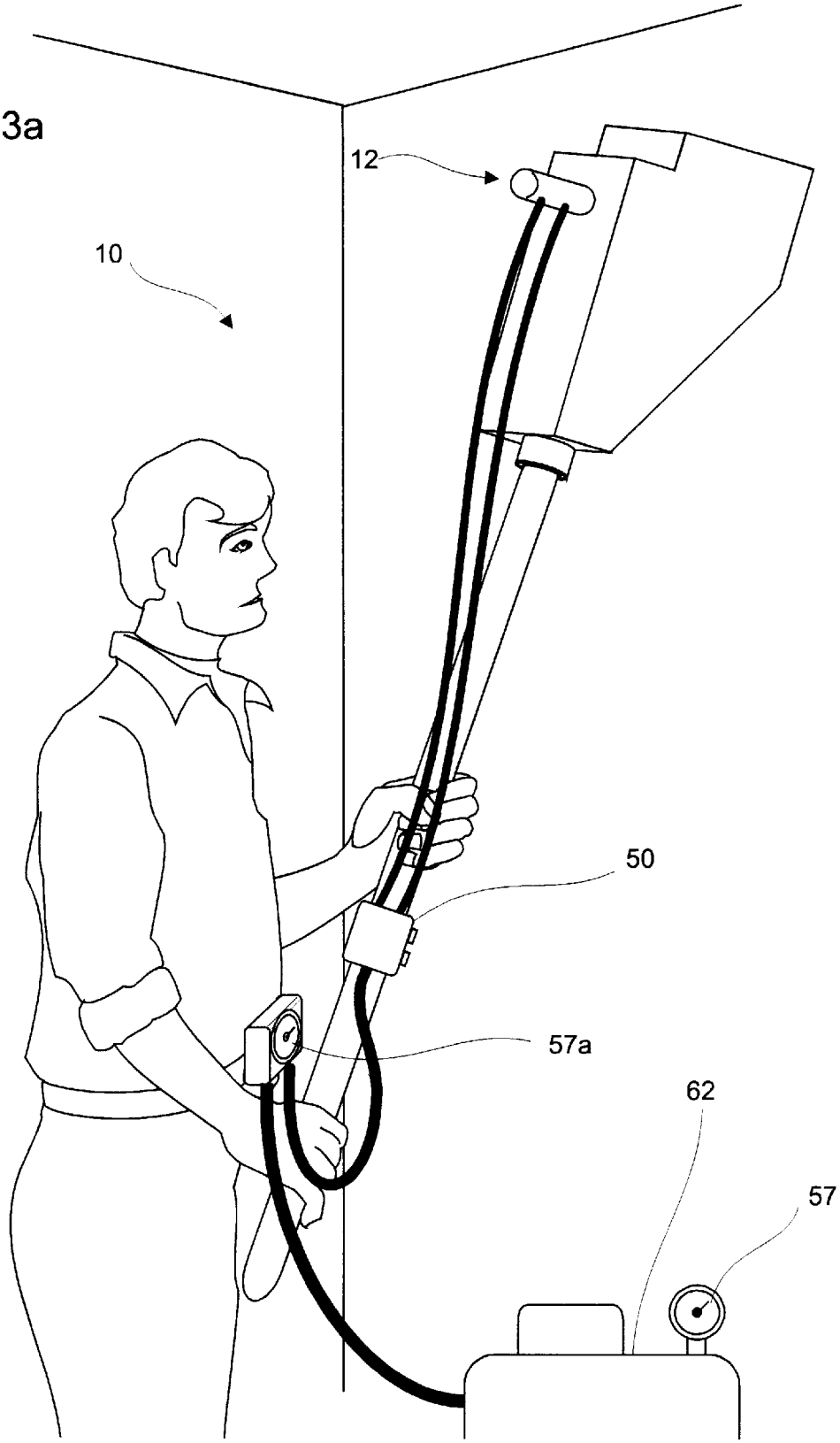
FIG. 3*a* is a view of the embodiment in FIG. 2*a* of the present invention in use.

The mud applicator 10 shown in FIGS. 2*a* and 3*a* differs in that the applicator 10 includes and additional regulator gauge 57*a* disposed in the line 60 for connection to a belt of the user, for example. Also, the regulator 50 is connected to the handle 15.

The above described embodiment is set forth by way of example and is not for the purpose of limiting the present invention. The present invention thus provides an new and useful mud applicator and an accessory tool for use with existing flat mud boxes. The invention provides significant advantages of providing a relatively lightweight mud applicator with a mechanical pumping aid to enable a person to apply mud with less physical exertion. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A mud applicator for applying mud to wall board, which includes:

a housing having a front open surface through which mud can pass, a plate pivotally movably connected within said housing such that said plate moves toward and away from said open surface, and wherein said housing has a mount member fixably disposed to said housing rearwardly of said plate with respect to said front open surface; and a pneumatic drive mechanism connected to said mount member and operably connected to said plate to cause said plate to move toward said open surface in a manner such that when mud is disposed in said housing, said plate forces said mud out of said front open surface and further includes means for automatically returning said plate toward said mount member, wherein said pneumatic drive mechanism includes a cylinder connected to said mount member and operatively disposed adjacent said plate, a piston operably reciprocally disposed in said cylinder such that said piston reciprocates in and out of said cylinder thereby contacting said plate in a driving manner toward said front open surface, and means connected to said cylinder for supplying pneumatic pressure to said cylinder and forcibly driving said piston toward said plate.

2. The mud applicator of claim 1, which includes means for biasing said plate away from said front open surface to permit said mud to be readily disposed into said housing through said front open surface.

3. The mud applicator of claim 1, which further includes an elongated handle extending from said housing.

4. The accessory tool of claim 3, which further includes a pressure regulator operably connected to said pneumatic drive mechanism and said handle.

5. The accessory tool of claim 1, which further includes a pressure regulator operably connected to said pneumatic drive mechanism.

* * * * *